US006021553A

United States Patent [19]

Bieber et al.

[11] Patent Number: 6,021,553

[45] Date of Patent: Feb. 8, 2000

[54] HAND-HELD BLIND RIVET RIVETING TOOL

[75] Inventors: Walter Bieber, Mörfelden-Walldorf; Hans Harder, Worfelden; Lothar Wille, Mörfelden-Walldorf; Richard Gossmann, Dietzenbach, all of Germany

[73] Assignee: Gesipa Blindniettechnik GmbH, Frankfurt, Germany

[21] Appl. No.: 09/257,424

[22] Filed: Feb. 25, 1999

[30] Foreign Application Priority Data

Mar. 5, 1998 [DE] Germany ..... 198 09 354

[51] Int. Cl.[7] ..... B21J 15/18

[52] U.S. Cl. ..... 29/243.521; 72/391.4

[58] Field of Search ..... 29/243.521, 243.527; 72/391.4

[56] References Cited

U.S. PATENT DOCUMENTS

| | | | |
|---|---|---|---|
| 3,376,727 | 4/1968 | Hinden | 29/243.521 |
| 3,906,774 | 9/1975 | Lapointe | 72/391.4 |
| 4,932,638 | 6/1990 | Chen | 29/243.521 |
| 5,323,521 | 6/1994 | Freund et al. | 29/243.527 |

FOREIGN PATENT DOCUMENTS

| | | |
|---|---|---|
| 130 757 A1 | 5/1978 | Germany . |
| 31 24 648 A1 | 1/1983 | Germany . |

*Primary Examiner*—David Jones
*Attorney, Agent, or Firm*—Darby & Darby

[57] ABSTRACT

A hand-held blind rivet riveting tool includes a housing and a drawing element mounted within the housing. The drawing element is movable in a drawing direction relative to the housing. A first grip lever is pivotable about a first pivot point relative to the housing. A second grip lever is connected to the housing. A connecting rod mechanism is disposed between the first grip lever and the drawing element. The connecting rod mechanism has a variable transmission ratio.

15 Claims, 3 Drawing Sheets

HAND-HELD BLIND RIVET RIVETING TOOL

BACKGROUND OF THE INVENTION

1. Field of the Invention

The present invention relates to a hand-held blind rivet riveting tool. More specifically, the present invention relates to a hand-held blind rivet riveting tool that includes a housing, a drawing element that can be displaced in a drawing direction relative to the housing, a first grip lever that is pivotable about a first pivot point relative to the housing, and a second grip lever connected to the housing.

2. Discussion of the Related Art

Conventionally, to set a blind rivet, the blind rivet's rivet shank is first introduced into an opening of a blind rivet tool. The rivet shank is then drawn into the tool. During this movement, the rivet shank is deformed on the side of the blind rivet that cannot be seen (i.e., the side within the riveting tool). The rivet pin eventually breaks, thereby resulting in the blind rivet being set. The procedure to set a blind rivet nut is similar to that of a blind rivet except that a drawing pin is usually screwed into the blind rivet nut. The drawing pin is not broken, After the blind rivet nut is set, the drawing pin is unscrewed from the now set blind rivet nut.

When setting either a blind rivet or a blind rivet nut, a certain tensile force must be applied to deform the rivet shank or rivet pin to produce the closing head. The blind rivet or blind rivet nut is inserted into the blind rivet riveting tool until the rivet head butts against an abutment of the tool. The rivet shank or pin is gripped by a drawing element within the tool. Grip levers of the tool are then moved toward one another, causing the drawing element and, therefore, the gripped rivet pin or shank to move away from the abutment to set the blind rivet or blind rivet nut.

Blind rivet riveting tools of the type described above are known from, for example, German Reference No. DE 31 24 648 A1. The grip lever in the German '648 reference is actuated by a user's thumb or the ball of the thumb. The grip lever is a single-armed lever which acts on a two-armed lever. A drawing element is fastened at the top of the two-armed lever. The single-armed lever and the two-armed lever are used to maintain the force applied by the user's hand relatively small.

U.S. Pat. No. 4,932,638 to Chen discloses a tool for setting expansion bolts. A grip lever acts on clamping plates, which are arranged around a drawing element. When the grip lever is actuated, one of the clamping plates wedges on the drawing element. Further movement of the grip lever causes the drawing element to be displaced.

German Reference No. DD 130 757 A1 discloses a blind rivet riveting tool that has an articulated head. The articulated head is disposed between the ends of two levers that form hand grips, thereby achieving a relatively high degree of leverage.

In all of these conventional tools, the setting of blind rivets and blind rivet nuts by hand is relatively laborious. If the grip width is enlarged so that the drawing element has a sufficient displacement to set a blind rivet, then it is often no longer possible for the handles to be actuated using only one hand. This problem is reduced somewhat by German Reference No. DE 31 24 648 A1 because it permits multiple ratcheting actuations of the grip lever during a single setting operation. But, because of the considerable friction losses produced by the large number of deflections, only some of the hand force applied by the user is used to set the blind rivet.

The tool disclosed in U.S. Pat. No. 4,932,638 to Chen loses some of the hand force to the displacement of the clamping plate to wedge the plate on the drawing element. Additionally, while the tool described in the '638 patent also permits multiple actuations of the grip levers in a single setting operation, this tool is not easy to use.

Accordingly, it is an object of the present invention to simplify the handling of a blind rivet riveting tool.

SUMMARY OF THE INVENTION

According to an exemplary embodiment of a hand-held blind rivet riveting tool according to the present invention, this and other objects are achieved with a connecting rod mechanism that has a variable transmission ratio between the first grip lever and the drawing element. The use of the connecting rod mechanism permits the pivot movement of the first grip lever to be converted into a linear movement of the drawing element. But, because the mechanism has a relatively small number of pivoting points, where friction losses may occur, there are virtually no friction losses in the blind rivet riveting tool of the present invention. In other words, the hand force applied by the user is used almost exclusively to set the blind rivet.

When the first grip lever is pivoted through a certain angle, the drawing element advances to different extents depending upon the angular position of the first grip lever. Thus, the tool takes into account the fact that the hand force of a user is not constant over his/her grip width. In fact, when the hand is open, the hand force is smaller than when the hand is virtually closed. Thus, with a hand opening width of 50%, the force that can be applied by an average hand is approximately double the force that can be applied with a hand opening width of 100%. In the hand-held blind rivet riveting tool of the present invention, when the grip levers have their largest spacing between them, a relatively small displacement of the drawing element results per angular unit of rotation of the first grip lever. Thus, a relatively small hand force is required when the grips are spaced apart to their largest extent. But when the grip levers have been further advanced towards one another (i.e., the spacing between the grip levers is reduced), a relatively larger displacement of the drawing element occurs, which, of course, requires a larger hand force. However, because the levers have a smaller opening width, a user will find it rather convenient or easy to apply this larger hand force.

The transmission ratio preferably drops constantly from an initial position where the first grip lever is spaced apart from the second grip lever by a maximum amount, to an end position where the first grip lever is spaced apart from the second grip lever by a minimum amount. The hand force required to move the drawing element depends upon how far the drawing element moves. Because the transmission ratio drops constantly, the drawing elements displacement increases as the first grip lever pivots toward the second grip lever. Thus, the hand force required to move the drawing element increases constantly as the first grip lever pivots toward the second grip lever. In other words, for the same angular adjustment of the first grip lever, the drawing element is displaced by a smaller amount at the beginning of the movement than at the end. Additionally, gaps or jumps in the movement of the drawing element are avoided so the blind rivet riveting tool is very convenient to use for this reason as well.

The first grip lever is pivotable about a first pivot point relative to the housing of the tool. The connecting rod mechanism preferably includes an intermediate lever that is pivotally connected to the first grip lever about a second pivot point. The intermediate lever is selectively engagable with the drawing element at an engagement location. The engagement location, the first pivot point and the second pivot point form an obtuse-angled triangle.

During movement of the first grip lever, the change in angle at the engagement location is relatively small. Thus, very small friction losses occur at the engagement location. The obtuse-angled triangle makes it possible to predetermine, relatively precisely, the desired profile of the transmission ratio. The obtuse angle is preferably located about the first pivot point. Thus, it is possible to predetermine, by selecting the angle, which component of the movement of the first grip lever will be used to advance the drawing element.

The triangle preferably remains obtuse-angled over the entire pivoting operating range of the first grip lever from its initial position to its end position. While an obtuse angle is hereby defined to include a right angle as a limit, the largest component is used, at this limit, to displace the drawing element.

The intermediate lever is preferably engagable in different axial positions with the drawing element. It is, thus, possible to set a blind rivet in multiple steps using the connecting rod mechanism. Upon actuation of the first grip lever, the drawing element is displaced by a predetermined maximum distance. In many cases, however, this distance is not sufficient to set the blind rivet. Thus, the first grip lever must be pivoted back to its initial position, thereby also moving the intermediate lever back to its initial position. However, while the first grip lever is moving back to its initial position, the drawing element must remain in its displaced position by a catch mechanism described below. Reactuation of the first grip lever causes the intermediate lever to act on the drawing element once again, but this time in a different axial position, which is displaced axially counter to the drawing direction. It is, thus, possible for the overall displacement of the drawing element to be divided up into a number of individual sub-displacements. Accordingly, only a relatively small application of force is necessary for each individual sub-displacement.

The drawing element preferably has a plurality of teeth that mesh with a plurality of teeth of the intermediate lever. Thus, there is a positively locking engagement between the intermediate lever and the drawing element so that relatively large tensile forces are transmitted to the drawing element. Meshing teeth produce a defined engagement point. Additionally, because meshing teeth are used, there is no need to ensure the necessary engagement of the intermediate lever and drawing element by displacing or tilting the intermediate lever with respect to the drawing element.

A catch is preferably pivotally connected to the housing about the first pivot point. The catch is selectively engagable with the drawing element. The catch prevents the drawing element from shifting back counter to the drawing direction when the intermediate lever is moved back into its initial position.

The catch preferably engages with the plurality of teeth of the drawing element. Thus, when producing the drawing element, the teeth need only be machined in a single area of the drawing element. Additionally, the catch acts on the drawing element in the same manner as the teeth of the intermediate lever (e.g., with the same pitch).

In the initial position, the intermediate lever butts against a pin that forms the first pivot point. Thus, it is relatively easy to release the engagement between the intermediate lever and the drawing element by pivoting the first grip lever forward (i.e., counter to its operating direction) beyond its initial position. The distance between the second pivot point and the first pivot point forms a lever arm which makes it possible to lift the intermediate lever out of engagement with the drawing element.

In the initial position, a pin, which forms the second pivot point, butts against the catch. Thus, when the first grip lever is pivoted forward beyond the initial position, both the intermediate lever and the catch are released from engagement with the drawing element. Because the catch is pivotable about the same first pivot point as the first grip lever, only a single, common swivel pin is required to pivotably mount these two elements within the housing. Additionally, because fewer parts are used, the relative movements amongst the first grip lever, the intermediate lever and the drawing element can be easily determined.

The first grip lever is preferably a finger lever. Thus, the tool is actuated more like a trigger of a gun than a tool that is actuated with the use of a user's thumb or the ball of the thumb. The blind rivet riveting levers can be guided more precisely because the tool housing is at rest while only the fingers are moved. Thus, a movement of the housing relative to the blind rivet is largely avoided, thereby minimizing the risk of an undesired shifting taking place when setting a blind rivet.

The drawing element is supported on a side of the drawing element that is opposite the connecting rod mechanism. The drawing element, thus, will not yield due to transverse forces so that the engagement between the connecting rod mechanism and the drawing element will remain intact.

The drawing element preferably includes a restoring spring and a clamping-jaw spring, both of which are supported on the housing. The restoring spring repositions the drawing element back into its initial position after a blind rivet has been set (e.g., when the catch and the intermediate lever are disengaged from the drawing element). When the drawing element is pushed back into its initial position, the clamping jaws must also release the broken rivet pin so that the tool will be available to receiving a new rivet pin. Since both springs are butted against the housing, they serve both for resetting of the drawing element. Since they are both supported by the housing the respective support can be made relatively stable.

The drawing element preferably has a damping ring connected to a forward end of the drawing element. The clamping ring may be formed, for example, by an O-ring that encloses the drawing element at a position where it comes into contact with an inner surface of the housing. The damping ring prevents an unpleasant striking action when the catch and the intermediate lever are disengaged from the drawing element.

The housing preferably has a collecting container that is selectively connected to the housing. Broken-off rivet pins are collected in the collecting container. Thus, the risk of accidents in the working, area due to broken-off rivet pins lying around is greatly reduced.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
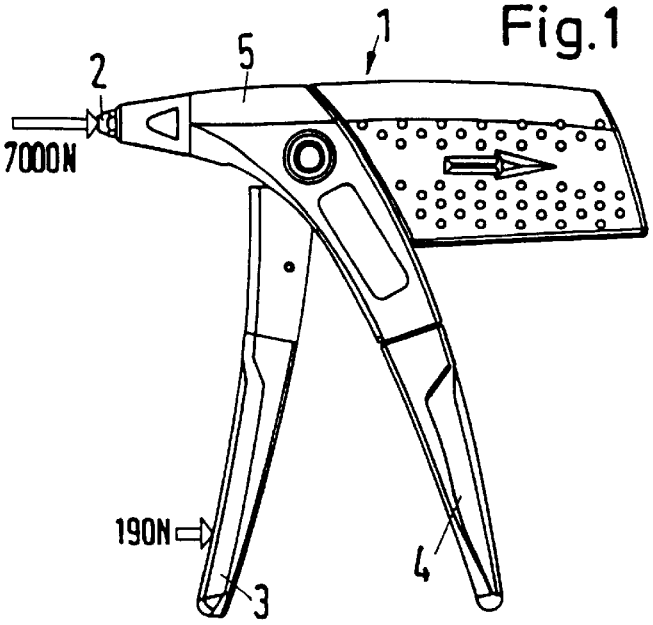
FIG. 1 is a side view of the blind rivet riveting tool in accordance with the present invention, with the grip levers in the initial position.
Figure 2:
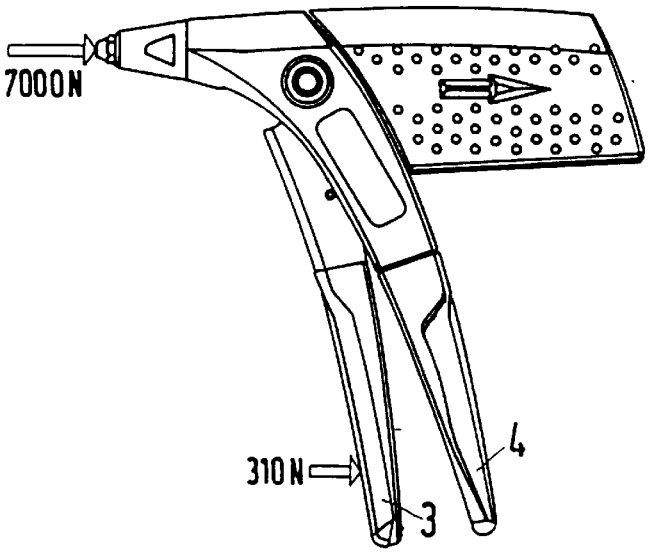
FIG. 2 is a side view of the blind rivet riveting tool with the grip levers in the end position.
Figure 3:
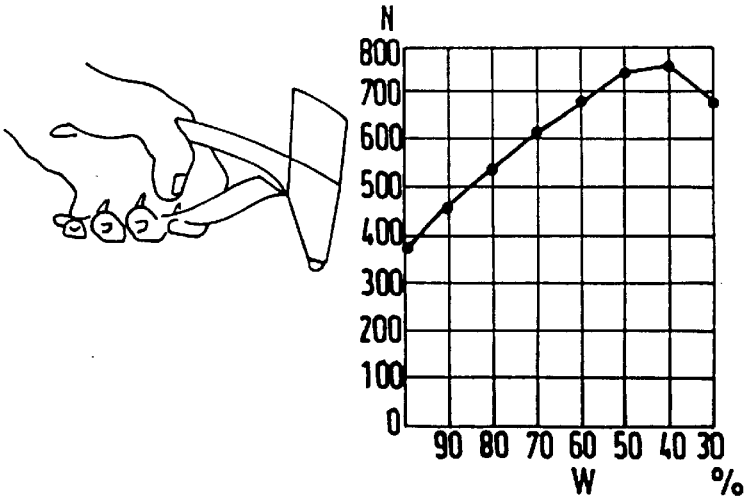
FIG. 3 is a schematic illustration of the hand force applied by the blind rivet riveting tool.

Referring now to FIGS. 1–3, a blind rivet riveting tool 1 in accordance with the present invention is illustrated. Blind rivet riveting tools are used to set blind rivets or blind rivet nuts. To set a blind rivet, a blind rivet pin is inserted into a mouthpiece 2 of the blind rivet riveting tool until the blind rivet head butts against the mouthpiece. The blind rivet riveting tool has a first, movable grip lever 3 and a second, fixed grip lever 4. Grip lever 4 is connected to a housing 5, on which mouthpiece 2 is also fastened. To set the blind rivet, the first grip lever 3 is pivoted toward the second grip lever 4. As grip lever 3 pivots, the rivet pin is first gripped and then is subject to a tensile force, which draws the rivet pin, by way of its thickened end, partially through the rivet shank and deforms the shank to produce the closing head. In the illustrated exemplary embodiment, a force of 7000 N is necessary to set the blind rivet. Of course, the force required to set a blind rivet is dependent on the blind rivet used. Because of the use of leverage, which will be discussed in conjunction with FIGS. 4–7 below, a force of 190 N is required at the beginning of the pivoting operation of first grip lever 3. This required force rises constantly as the pivot angle increases and in the end position, which is illustrated in FIG. 2, is 310 N.

This variable force transmission takes into account the physiological conditions, which are illustrated in FIG. 3. The human hand can apply a higher force as its grip closes. Accordingly, the opening width (W) of the hand is plotted, in percentage (%), on the horizontal axis. The normal force that the human hand can apply is plotted, in Newtons (N), on the vertical axis. It can be seen therefrom that the hand at its largest opening width can apply only approximately 50% of the force that it can apply with an opening width of 40%. Thus, a user will find the tool according to the present invention very easy to use, despite the fact that a constant tensile force is being applied at the mouthpiece 2, because the tool uses a variable transmission ratio (i.e., a transmission profile) so that a rising force can be applied by the user's hand while pivoting the first grip lever.

Referring now to FIGS. 4–7, the inner construction of the blind rivet riveting tool is illustrated. Mouthpiece 2 is screwed into housing 5. Housing 5 is integrally connected to second grip lever 4. Housing 5 is illustrated in a closed state, but the blind rivet riveting tool 1 may have an open housing and still function.

First grip lever 3 pivots about a pin 6 in housing 5. Pin 6 forms a first pivot point for first grip lever 3. An intermediate lever 7 is mounted on first grip lever 3. Intermediate lever 7 is pivotable about a pin 8, which forms a second pivot point for intermediate lever 7 (See FIG. 6).

Intermediate lever 7 has, at its end remote from pin 8, a plurality of teeth 9. Teeth 9 engage with a drawing element 10, which has a correspondingly shaped plurality of teeth 11. Teeth 11 extend along the drawing element 10 in the drawing direction for a considerably longer length than the length that teeth 9 extend on intermediate lever 7. Thus, it is possible for intermediate lever 7 to engage with the drawing element 10 at different axial positions along drawing element 10. It is, therefore, also possible for the overall displacement of drawing element 10 to be subdivided into a number of sub-displacements. For each sub-displacement, first grip lever 3 is pivoted through its entire pivot movement (i.e., from its initial position of FIG. 1 to its end position of FIG. 2).

During this pivot movement, first grip lever 3, together with the intermediate lever 7, form a connecting rod mechanism. The first pivot point of pin 6, the second pivot point of pin 8 and the engagement point 9 together form an obtuse-angled triangle, with the obtuse angle being formed at pin 6. Engagement point 9 is the rear most point of engagement of teeth 9 with teeth 11. The pivot point of pin 8 executes a circular movement about pin 6. This circular movement is converted, at the engagement point between teeth 9, 11, into a linear movement of drawing element 10. Since the pivot angle is selected such that the triangle remains obtuse-angled over the entire pivot movement of first grip lever 3, the angle formed about pin 6 for the above identified obtuse-angled triangle is always at least 90°. The angle movements cannot now simply be linearized to determine the movement of drawing element 10 because there is a considerable increase in the displacement of drawing element 10 as the pivot angle of the first grip lever 3 increases. It is possible, however, to determine the movements of drawing element 10 by first determining the two rotary movements about pins 6 and 8 because the change in the engagement geometry between teeth 9, 11 is so small as to be negligible. Additionally, there are virtually no friction losses between teeth 9, 11 due to the minimal relative movement between these teeth.

Drawing element 10 is supported by a roller 12 in housing 5 on a side of drawing element 10 that is opposite from teeth 11. Thus, even small forces that act transversely with respect to the drawing direction of drawing element 10 cannot force drawing element 10 out of alignment from the drawing direction.

Figure 6:
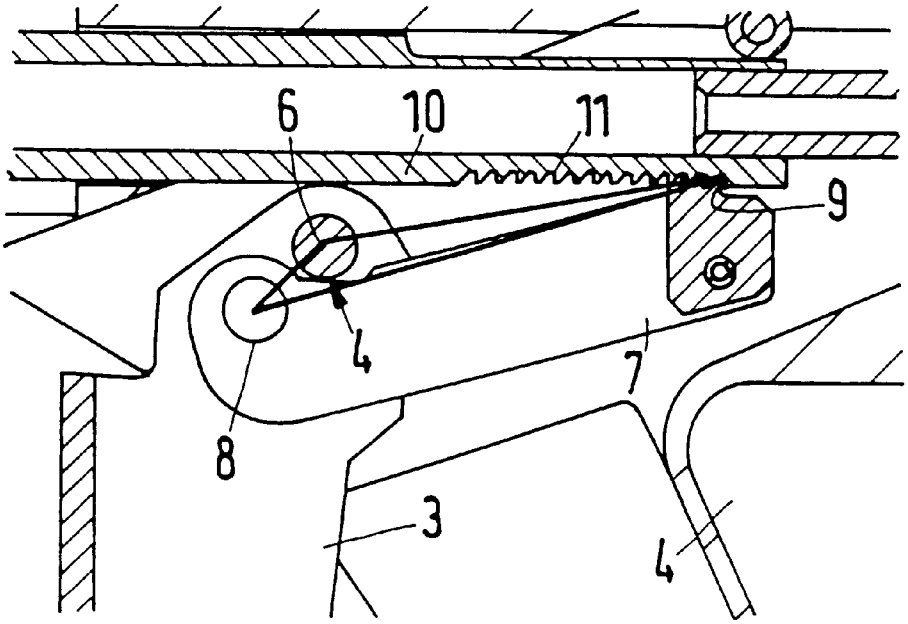
FIG. 6 is an enlarged detail of FIG. 4.
Figure 7:
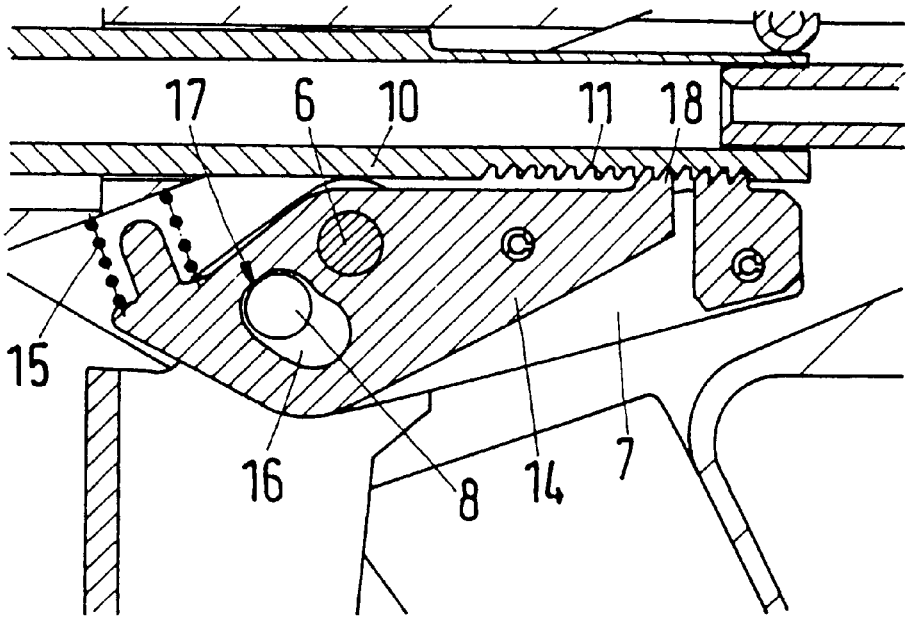
FIG. 7 is an enlarged detail similar to FIG. 6, but showing additional components.

Intermediate lever 7 is biased against drawing element 10 by a spring 13. Spring 13 also biases the first grip lever 3 toward the initial position of FIG. 1. As illustrated in FIG. 6, teeth 9, 11 are designed so that their engaging tooth flanks are disposed normal to the drawing direction when drawing element 10 is forced to the right (i.e., in the drawing direction). The non-engaging tooth flanks of teeth 9, 11 are inclined so that, during a rearward movement of first grip lever 3 (i.e., in the clockwise direction as illustrated in the drawing Figures), intermediate lever 7 will slide or ratchet over teeth 11. A catch 14 is biased against drawing element 10 to ensure that drawing element 10 remains in its axial position during this rearward movement of intermediate lever 7 (see FIG. 7). Spring 15 butts against housing 5 to provide a biasing force against catch 14. Catch 14 is pivotally mounted on the same pin 6 as the first grip lever 3. Catch 14 has a slot 16 through which pin 8 is guided. Slot 16 is of such a size so that first grip lever 3 is able to move through its maximum possible pivot angle (i.e., its entire pivot movement) of, for example, 25° without pin 8 coming into contact with catch 14.

Catch 14 has a plurality of teeth 18, which are shaped like teeth 9. Teeth 18, therefore, engage with teeth 11 of drawing element 10 in a similar manner as teeth 9 engage with teeth 10. The interaction of intermediate lever 7 and catch 14, the two of which act on the same teeth 11 of drawing element 10, produces a ratchet effect. During the rearward movement of intermediate lever 7, catch 14 prevents drawing element 10 from being displaced back again as well.

Figure 4:
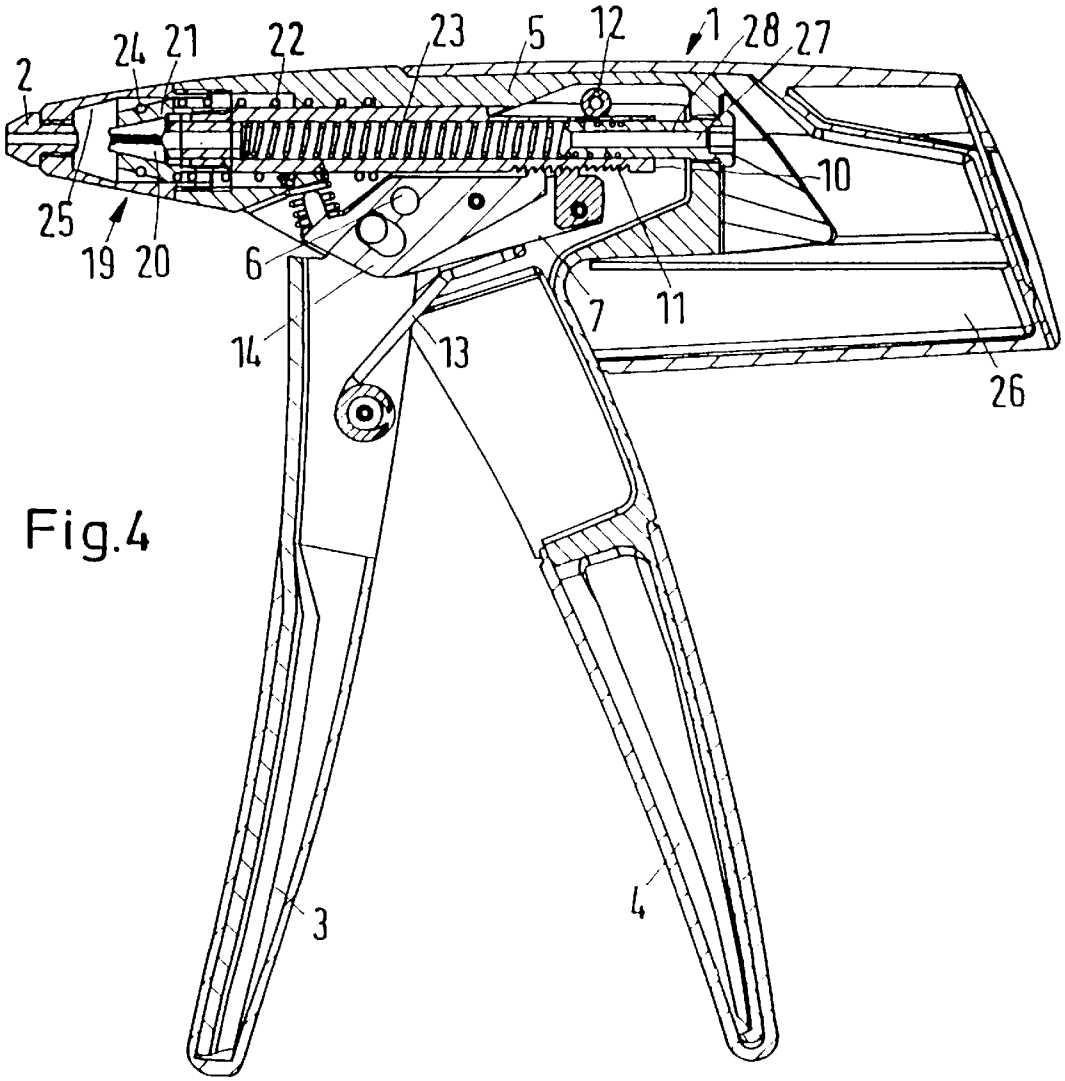
FIG. 4 is a cross sectional view of the blind rivet riveting tool.

To release catch 14 and intermediate lever 7, the first grip lever 3 is pivoted open a little further (i.e., in the clockwise direction) from its initial position, which is illustrated in FIG. 4. As illustrated in FIG. 6, the intermediate lever 7, in its initial position, butts against pin 6 or is spaced apart therefrom to a very small extent. If the first grip lever 3 is displaced further in the clockwise direction, intermediate lever 7, which is secured on the first grip lever 3 by pin 8, is moved about pin 6 by a lever action and is disengaged from drawing element 10. Pin 8 acts on catch 14 in the same manner. Pin 8 butts against a catch surface 17, which forms a boundary of slot 16. When the first grip lever 3 is pivoted open past its initial position, catch 14 is also disengaged from teeth 11 of drawing element 10.

Teeth 18 of catch 14 have inclined tooth flanks that match the shape of inclined teeth flanks on drawing element 10. Drawing element 10 may thus be displaced to the right (i.e., in the drawing direction) by lever 7. During this drawing movement, catch 14 is forced downward on the right-hand side counter to the force of spring 15 on the left-hand side. When lever 3 moves from the end position back to the initial position, catch 14 blocks the movement of drawing element 10 in the opposite non-drawing direction because of the engagement of the essentially transverse tooth flanks of teeth 18, 11 abutting against one another.

Drawing element 10 has at its front end adjacent to mouthpiece 2. Gripping mechanism 19 secures a rivet pin during the drawing operation. Gripping mechanism 19 has clamping jaws 20, which taper conically on their outer surface toward the front of the tool. Clamping jaws 20 are enclosed by a clamping jaw housing 21, which has a correspondingly shaped inner cone. When the drawing mechanism is drawn in the drawing direction (i.e., to the right in FIG. 4), clamping jaw housing 21 applies a radially inwardly directed force to clamping jaws 20 to securely hold a rivet pin in a manner that is known in the art.

A restoring spring 22 is supported on housing 5 and biases drawing element 10 in the non-drawing direction (i.e., in the direction back towards mouthpiece 2). Thus, if catch 14 and intermediate lever 7 are in the unlocked position, restoring setting 22 will push drawing element 10 back into its initial position. A clamping jaw spring 23 is disposed in the interior of drawing element 10. Spring 23 is also supported on housing 5. Clamping jaw spring 23 also biases drawing element 10 in the non-drawing direction.

Restoring spring 22 and clamping jaw spring 23 work together to push clamping jaws 20 in the non-drawing direction until they butt against mouthpiece 2. Restoring spring 22 pushes clamping jaw housing 21 a little further in the non-drawing direction so that the clamping jaws 20 can open radially. Thus, restoring spring 22 can be relatively weak because it is only required to displace the clamping jaw housing 21 in the non-drawing direction after jaws 20 abut mouthpiece 2. Additionally, restoring spring 22 can be made relatively weak because it does not act counter to the biasing force applied by clamping jaw spring 23.

An O-ring 24 is disposed on an outer conical circumferential surface of clamping jaw housing 21. During the movement of drawing element 10 back into its initial position, O-ring 24 butts against a correspondingly shaped inner conical surface 25 of housing 5 to dampen the stopping of drawing element 10. Thus, hard striking actions against the user's hand are avoided.

Figure 5:
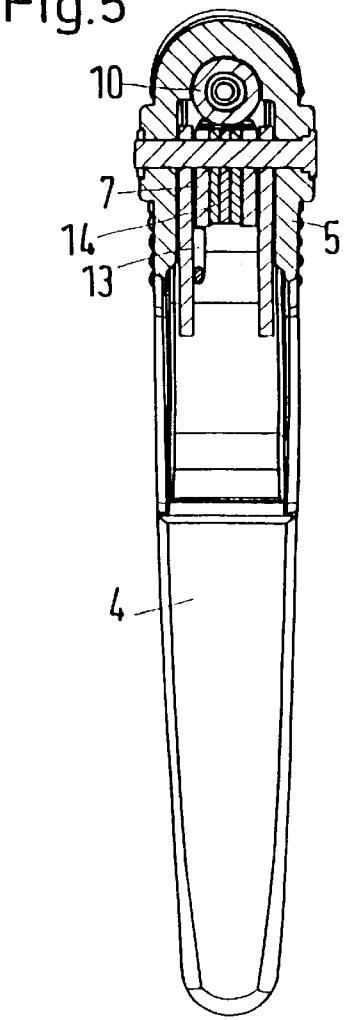
FIG. 5 is a cross sectional longitudinal view of the blind rivet riveting tool.

Referring now to FIG. 5, intermediate lever 7 is illustrated having a U-shape to accommodate catch 14 between the U to allow for a very stable geometry to be realized in the hand held blind rivet tool in accordance with the present invention.

A container 26 is fitted at that end of the blind rivet riveting tool 1 that is remote from mouthpiece 2. Container 26 is connected to a through opening 27 in housing 5. Opening 27 is also connected to the hollow interior of drawing element 10. Through opening 27 is disposed within a bolt 28, which is mounted in housing 5. Through opening 27 opens conically at its front end (i.e., the end facing mouthpiece 2). The front end of bolt 28 acts as a n abutment for clamping jaw spring 23. Gripping mechanism 19 opens as the drawing element 10 is restored back to its initial position. The broken-off rivet pins then drop through opening 27 into container 26. From time to time, container 26 should be emptied. Utilizing container 26 reduces the risk of accidents occurring in the workplace as a result of rivet pins lying around.

The operation of the blind rivet riveting tool of the present invention to set blind rivets (or blind rivet nuts) is described below. The overall displacement that is necessary to set a blind rivet is divided up into a number of sub-displacements. During each sub-displacement, first grip lever 3 is pivoted through its entire pivot movement from its initial position to its end position. The entire pivot movement of the first grip lever 3 with respect to the second grip lever 4 is set such that the user can easily actuate both grip levers with one hand. First grip lever 3 is preferably designed as a finger lever (i.e., the fingers of the user's hand rest against the first grip lever 3 when held). With an increasing pivot movement of the first grip lever 3 with respect to the second grip lever 4, the force which is necessary to produce movement rises. But because the user can apply a larger force as the pivot angle increases (or more accurately, as the hand opening width decreases), the fact that the required force increases with increasing pivoting movement does not impair the ease of use of the blind rivet riveting tool of the present invention. This force profile is produced for each sub-displacement.

In one example of the use of the blind rivet riveting tool of the present invention, the overall displacement was divided up into nine individual sub-displacements. An aluminum blind rivet was used, which had a diameter of 4 mm, and the load at fracture was 3650 N. This aluminum blind rivet can have its rivet pin broken off with a hand force of 180–230 N, depending on the position of the first grip lever 3.

In another example, a 5-mm aluminum rivet, having a load at fracture of 5400 N was used. The hand force required to break the rivet pin is in the range from 220 to 270 N, depending on the position of the first grip lever 3.

In prior-art tools, the necessary hand forces required to break the rivet pin are in the range from 300 to 340 N for the first example described above and from 440 to 470 N for the second example.

The large number of sub-displacements makes it possible to achieve large overall displacement lengths of, for example, approximately 16 mm. Thus, excessively long blind rivets or multi-span blind rivets can be processed by the blind rivet riveting tool of the present invention without any difficulty.

Having described the presently preferred exemplary embodiment of a hand-held blind rivet riveting tool in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A hand-held blind rivet riveting tool comprising:

a housing;

a drawing element mounted within said housing, said drawing element being movable in a drawing direction relative to said housing for riveting a rivet pin during movement of said drawing element in said drawing direction;

a first grip lever being pivotable about a first pivot point relative to said housing;

a second grip lever being connected to said housing; and a connecting rod mechanism being disposed between said first grip lever and said drawing element, said connecting rod mechanism having a variable transmission ratio, said transmission ratio dropping constantly from an initial position where said first grip lever is spaced apart from said second grip lever by a maximum amount to an end position where said first grip lever is spaced apart from said second grip lever by a minimum amount.

2. The blind rivet riveting tool as claimed in claim 1, wherein said connecting rod mechanism includes an intermediate lever that is pivotally connected to said first grip lever about a second pivot point, said intermediate lever being in selective engagement with said drawing element at an engagement location, said engagement location, said first pivot point and said second pivot point forming an obtuse-angled triangle.

3. The blind rivet riveting tool as claimed in claim 2, wherein said triangle remains obtuse-angled over an entire pivoting operating range of said first grip lever from said initial position to said end position.

4. The blind rivet riveting tool as claimed in claim 2, wherein said intermediate lever is engagable in different axial positions with said drawing element.

5. The blind rivet riveting tool as claimed in claim 4, wherein said drawing element has a plurality of teeth that mesh with a plurality of teeth of said intermediate lever.

6. The blind rivet riveting tool as claimed in claim 4, further comprising a catch pivotally connected to said housing about said first pivot point, said catch being in selective engagement with said drawing element.

7. The blind rivet riveting tool as claimed in claim 6, wherein said catch engages with said plurality of teeth of said drawing element.

8. The blind rivet riveting tool as claimed in claim 2, wherein, in said initial position, said intermediate lever butts against a pin which forms said first pivot point.

9. The blind rivet riveting tool as claimed in claim 6, wherein, in said initial position, a pin which forms said second pivot point butts against said catch.

10. The blind rivet tool as claimed in claim 9 wherein said catch is pivotally mounted on the same pivot point as the first grip lever.

11. The blind rivet riveting tool as claimed in claim 1, wherein said first grip lever (3) is a finger lever.

12. The blind rivet riveting tool as claimed in claim 1, wherein said drawing element (10) is supported on a side that is opposite said connecting rod mechanism (3, 7).

13. The blind rivet riveting tool as claimed in claim 1, further comprising a restoring spring (22) and a clamping jaw spring (23), both of said springs (22, 23) being supported in said housing (5).

14. The blind rivet riveting tool as claimed in claim 1, further comprising a damping ring (24) being connected to said drawing element (10).

15. The blind rivet riveting loot as claimed in claim 1, further comprising a collecting container (26) being selectively connected to said housing (5).

* * * * *